US006005451A

United States Patent [19]

Wendel

[11] Patent Number: 6,005,451

[45] Date of Patent: Dec. 21, 1999

[54] MICROWAVE ELEMENT

[75] Inventor: Ralf Wendel, Pinneberg, Germany

[73] Assignee: U.S. Philips Corporation, New York, N.Y.

[21] Appl. No.: 08/924,940

[22] Filed: Sep. 8, 1997

[30] Foreign Application Priority Data

Sep. 11, 1996 [DE] Germany ..... 196 36 840

[51] Int. Cl.[6] ..... H01P 1/387

[52] U.S. Cl. ..... 333/1.1; 333/246

[58] Field of Search ..... 333/1.1, 24.2; 174/52.1–52.3

[56] References Cited

U.S. PATENT DOCUMENTS

| | | | |
|---|---|---|---|
| 4,749,965 | 6/1988 | Prevot et al. | 333/1.1 |
| 4,812,787 | 3/1989 | Kuramoto et al. | 333/1.1 |
| 5,068,629 | 11/1991 | Nishikawa et al. | 333/1.1 |
| 5,159,294 | 10/1992 | Ishikawa et al. | 333/1.1 |

*Primary Examiner*—Paul Gensler
*Attorney, Agent, or Firm*—Gregory L. Thorne

[57] ABSTRACT

A microwave element is described with a substantially trough-shaped housing part having a bottom portion and at least one wall portion merging into the circumference of the bottom portion. A lid part, together with the housing part, encloses an inner space in which a number of substantially disc-shaped components are present in a stacked arrangement between the bottom portion and the lid part. The microwave element renders possible an inexpensive manufacture without sacrificing any operational properties. The housing part and the lid part are each formed as an integral part without any cutting operation from a magnetically permeable material. The lid part is directly connected to the housing part by matching and mutually retaining shapes. A magnetically impermeable spacer element is arranged adjacent to the stacked arrangement of the disc-shaped components. The magnetically impermeable spacer element is substantially the full height of the inner space between the bottom portion and the lid part so as to fill up with matching shape any intermediate space between the stacked arrangement of the disc-shaped components and the wall portion along at least part of that dimension of the wall portion which extends in the direction of the circumference of the bottom portion.

12 Claims, 5 Drawing Sheets

MICROWAVE ELEMENT

BACKGROUND OF THE INVENTION

The invention relates to a microwave element comprising a substantially trough-shaped housing part with a bottom portion and at least one wall portion merging into the circumference of the bottom portion and comprising a lid part, which housing part and lid part enclose an inner space in which a number of substantially disc-shaped components are arranged in a stack between the bottom portion and the lid part.

U.S. Pat. No. 5,384,556 discloses a microwave circulator which comprises a housing in which an arrangement of a first ferrite disc, an inner conductor, a second ferrite disc, an outer conductor, and a magnet is present. These components are arranged in a stack between a bottom portion of the housing and a lid, and a compression spring presses this arrangement against the bottom portion of the housing. The compression spring is retained against the upper inner circumference of the housing by means of a snap ring. The housing is manufactured as a cylindrical turned part from nickel-plated steel. The bottom portion here has a circular circumference merging into all wall portions in the form of cylinder shells which are separated from one another by gaps. This arrangement is provided for the inner contour of the housing in all cases, whereas its outer contour may alternatively be rectangular. In any case, a groove for the snap ring is incorporated into the upper inner circumference of the housing formed by the upper edges of the wall portions.

The manufacture of the housing according to this known construction is found to be particularly laborious and expensive since it comprises several manufacturing steps especially on turning and milling machines. These expensive manufacturing steps lead to a substantial price increase of the entire device in particular in the manufacture of large series.

SUMMARY OF THE INVENTION

The invention has for its object to provide a microwave element, for example a microwave circulator, whose manufacture can take place in an inexpensive manner without sacrificing any operational properties.

According to the invention, this object is achieved in a microwave element of the kind mentioned in the opening paragraph in that

- the housing part on the one hand and the lid part on the other hand are each formed as an integral part without any cutting operation from a magnetically permeable material,
- the lid part is directly connected to the housing part by means of matching and mutually retaining shapes, and
- a magnetically impermeable spacer element is arranged adjacent the stacked arrangement of the components in at least substantially the full height of the inner space between the bottom portion and the lid part so as to fill up with matching shape any intermediate space between the stacked arrangement of the components and the wall portion(s) along at least part of that dimension of the wall portion(s) which extends at least substantially in the direction of the circumference of the bottom portion.

The measures according to the invention appreciably reduce not only the manufacturing cost for the housing part of the microwave element but also the cost of mounting the components to be arranged in the inner space thereof. A particularly great saving is achieved in the manufacture of the trough-shaped housing part compared with the construction according to U.S. Pat. No. 5,384,556. The trough-shaped housing part may be manufactured, for example, by deep-drawing or embossing, but preferably by stamping and/or bending, only a single or at most two processing steps being ideally required in the latter case. This trough-shaped, single-piece housing part, for example formed from a single metal sheet, is directly connected through matching and mutually retaining shapes to the lid part, which was also manufactured as a single piece, in particular as a stamped piece, during assembling of the microwave element, after the components to be arranged in the inner space of the housing part have been inserted, i.e. edges of the wall portion(s) of the housing part facing away from the bottom portion of the housing part have contours adapted to the lid part and are connected to the latter without additional fastening elements such as, for example, screws or snap rings. This connection may be achieved preferably by gluing, soldering, or welding.

The spacer elements arranged according to the invention between the stacked arrangement of the components in the inner space of the housing part and the wall portion(s) in the microwave element according to the invention serve on the one hand for a simple and precise centering of the components, while on the other hand they may provide the microwave element with different operational properties owing to the material chosen for them. The spacer element (s) is (are) formed from a magnetically impermeable material so as not to influence the magnetic properties of the housing part and the lid part, which are formed from a magnetically permeable material. The spacer element(s) may be inserted in a simple manner into the trough-shaped housing part together with the components in stacked arrangement during the assembly of the microwave element according to the invention: an additional fixation, for example with an adhesive agent, is unnecessary because of the matching shapes of the spacer element(s) between the components arranged in a stack and the wall portion(s). It should be noted in this connection that it is known from U.S. Pat. No. 5,384,556 to provide a sandwich arrangement of two ferrite discs and a conductor between them in the inner space of the housing. The ferrite discs shown therein each comprise a part made of ferrite material in the form of a circular disc, surrounded by a dielectric ring which may be made from a ceramic material. Ferrite discs of this kind in the circulator described in U.S. Pat. No. 5,384,556 have the object of reducing the electrical losses in wide-band applications.

The present invention in addition provides for each disc-shaped component at least one spacer element up to the wall portion(s) of the housing part so that a saving in dimensions and weight is achieved for the components arranged in a stack while the assembling process nevertheless remains easy.

Preferably, the microwave element according to the invention is constructed such that the spacer element(s) has (have) substantially a ring shape so that said spacer element (s) at least substantially surround(s) the stacked arrangement of the components along the circumference of the bottom portion or the dimension of the wall portion(s) extending at least substantially in the direction thereof. This construction leads to a particularly simple assembling process and at the same time to a particularly robust fixation of the components. In addition, a symmetrical construction of the spacer element(s) also benefits the electromagnetic properties of the microwave element according to the invention.

In an advantageous further embodiment of the microwave element according to the invention, at least one of the substantially disc-shaped components is constructed as an electrical conductor, and the spacer element(s) adjoining said electrical conductor(s) is (are) formed from an electrically non-conductive material. The spacer element(s) in this case perform(s) not only the mechanical retention function but also that of electrical insulation. They may in particular be formed from a material having a high dielectric constant. This may be, for example, a synthetic resin or a ceramic material, or a ceramic material embedded in a synthetic resin such that at least a substantial portion of the intermediate space between the stacked arrangement of the components and the wall portion(s) having said high dielectric constant adjoining the electrical conductor is filled up. This space is then advantageously available for use for compact electrical or electronic circuit elements, which render it possible to achieve a high integration density with the microwave element according to the invention, thus reducing cost and dimensions of a microwave circuit arrangement to be built up with the microwave element according to the invention in a favorable manner.

It is in addition advantageous for soldering or welding of the lid part to the trough-shaped housing part when, in a further embodiment of the invention, the spacer element(s) is (are) formed from a heat-resistant material. This may be a heat-resistant synthetic resin or alternatively a ceramic material.

The microwave element according to the invention may be used in particular for forming a microwave circulator or a microwave isolator. For the latter purpose, preferably, a load, in particular an ohmic component, may be connected to the electrical conductor in the region having the high dielectric constant described above.

BRIEF DESCRIPTION OF THE DRAWING

An embodiment of a microwave element according to the invention is shown in the drawing and will be explained in more detail below. In the drawing.

Corresponding parts have been given the same reference numerals in all Figures of the drawing.

DETAILED DESCRIPTION OF THE PREFERRED EMBODIMENTS

Figure 1:
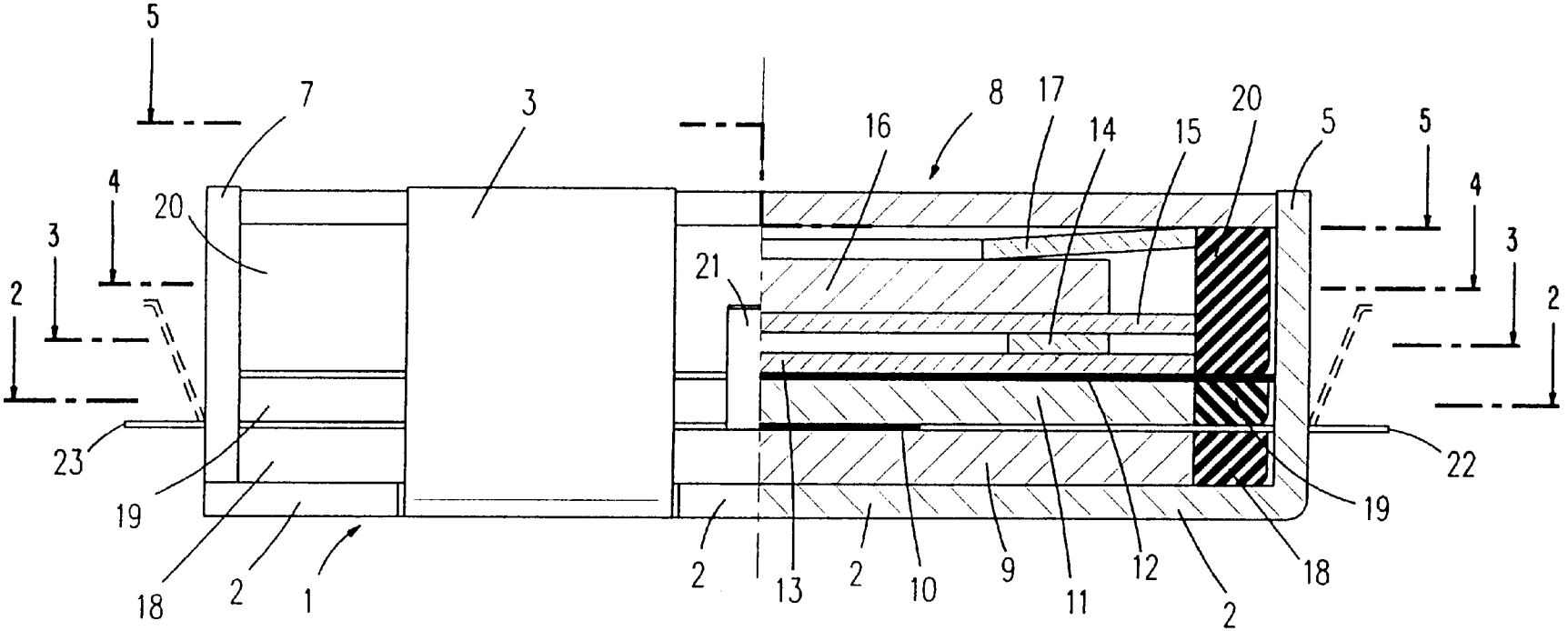
FIG. 1 shows a microwave element according to the invention in side elevation, partly in cross-section taken on the line A—A in FIG. 2.

The microwave element shown by way of example in the drawing represents a circulator operating by the conductor strip principle, comprising a trough-shaped housing part 1 which is formed by a bottom portion 2 and a total of five wall portions 3, 4, 5, 6, 7 merging into the circumference of the bottom portion. The bottom portion 2 and the wall portions 3 to 7 were integrally stamped and bent from a magnetically permeable metal plate, the wall portions 3 to 7 merging perpendicularly into the circumference of the bottom portion 2, which is rectangular here. Gaps are left open between the individual wall portions 3 to 7, through which gaps the conductor strip connections can be passed from the housing part to the exterior.

The housing part 1 is closed with a lid part 8 which is also stamped from a magnetically permeable metal plate and which is welded to the edges of the wall portions 3 to 7 remote from the bottom portion 2. If so desired, this connection may alternatively be made through soldering or gluing, however, this would require the use of additional material.

Figure 2:
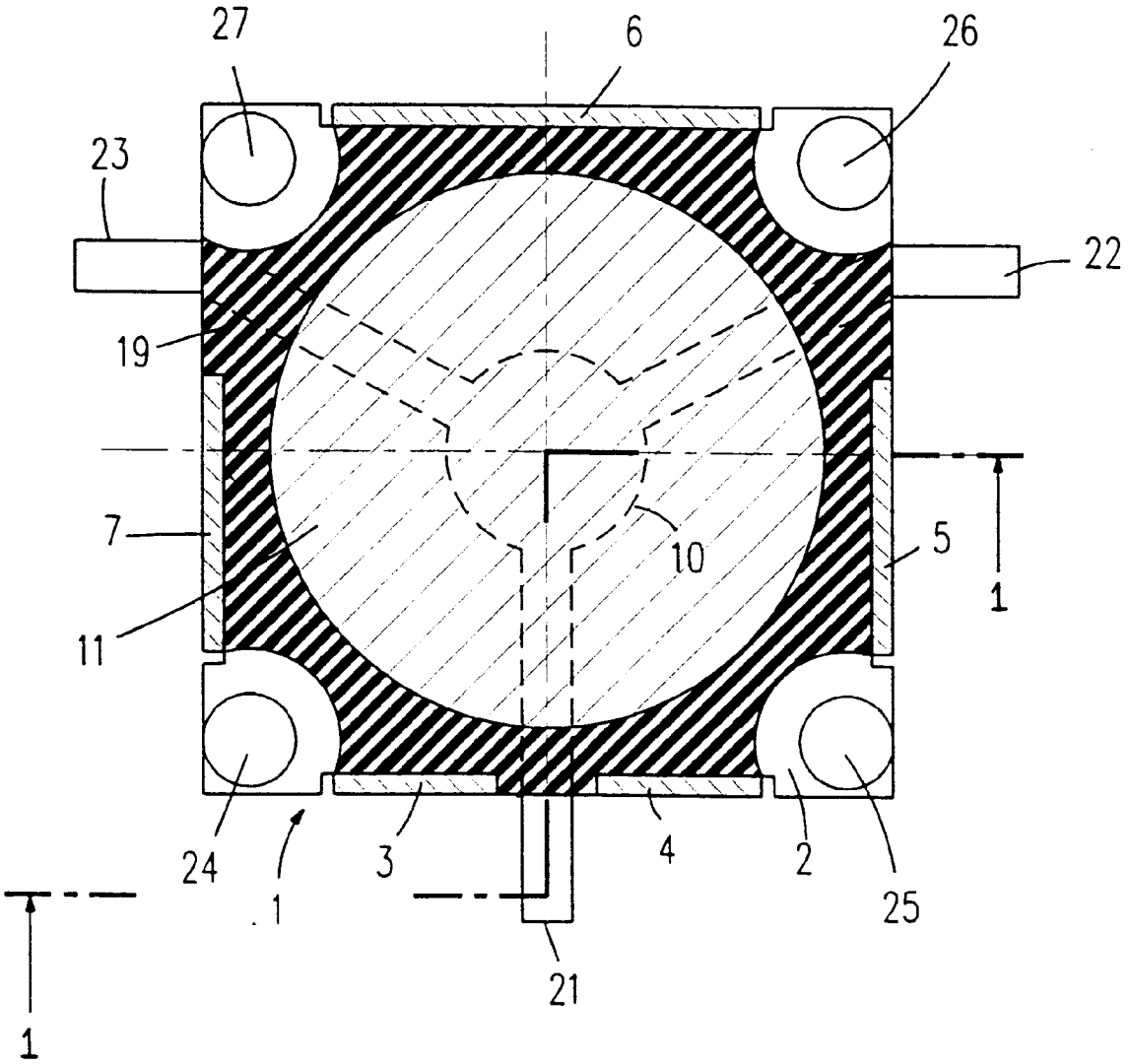
FIG. 2 is a cross-section of the microwave element taken on the line B—B in FIG. 1.
Figure 3:
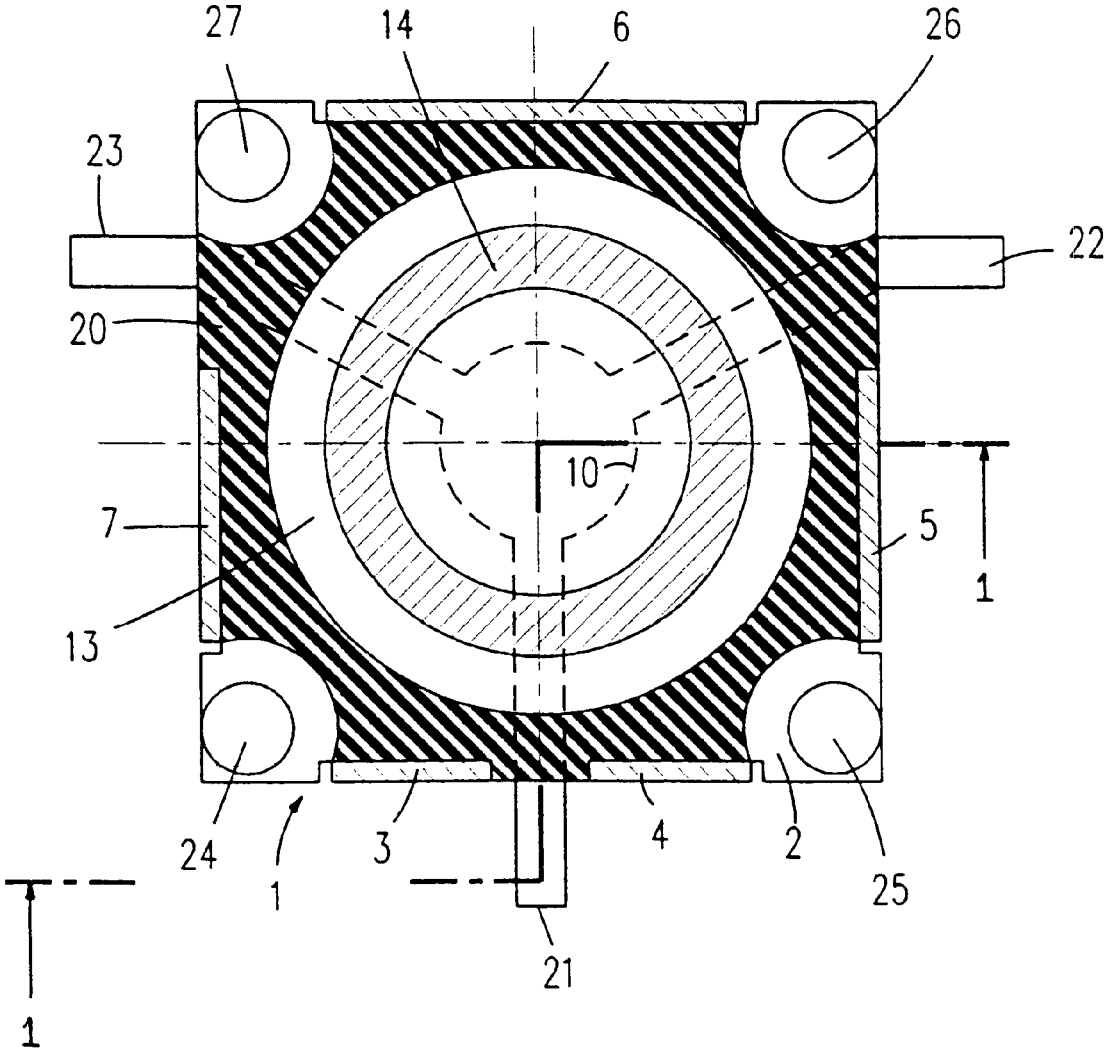
FIG. 3 is a cross-section of the microwave element of FIG. 1 taken on the line C—C.
Figure 4:
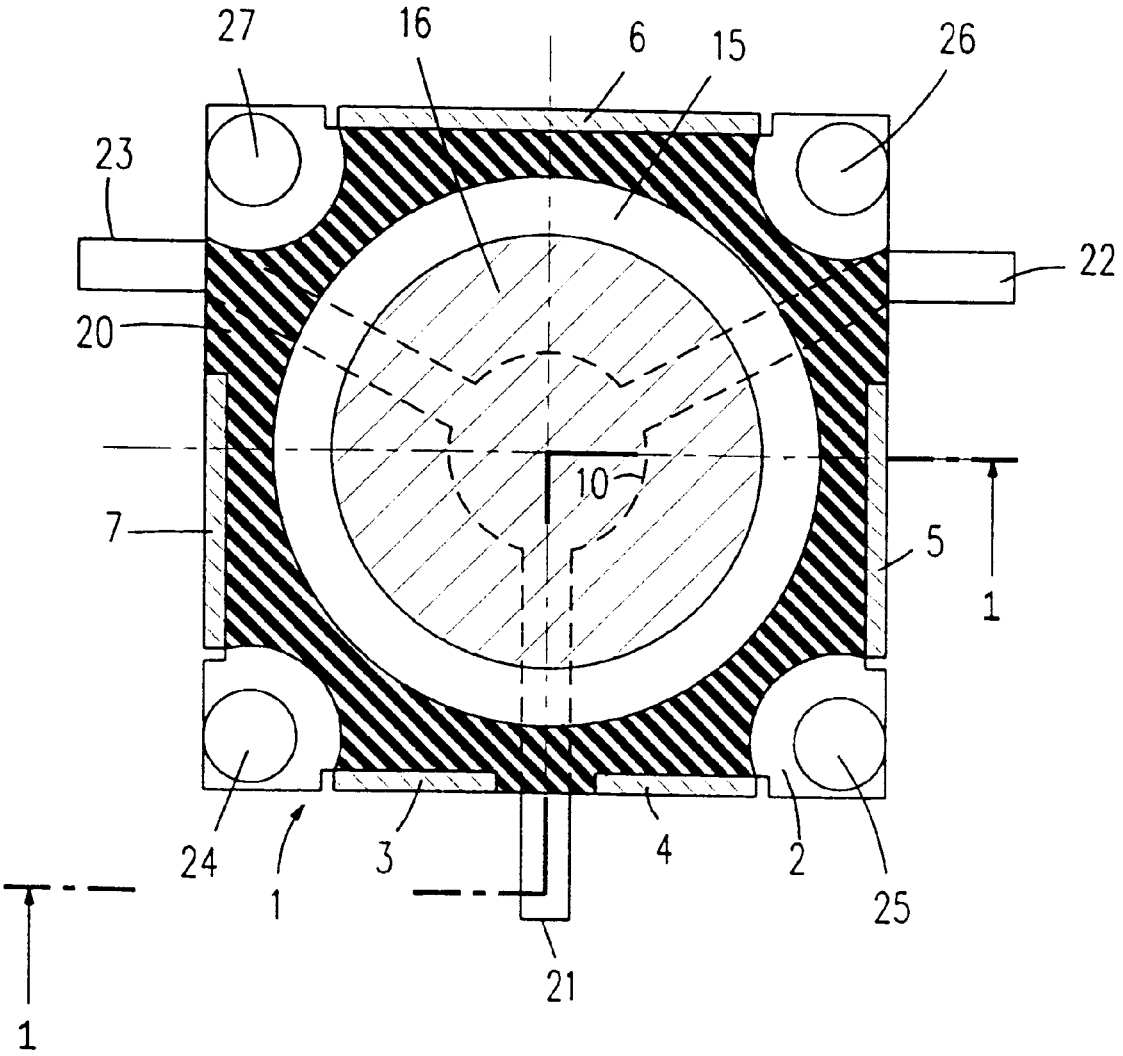
FIG. 4 is a cross-section of the microwave element of FIG. 1 taken on the line D—D.
Figure 5:
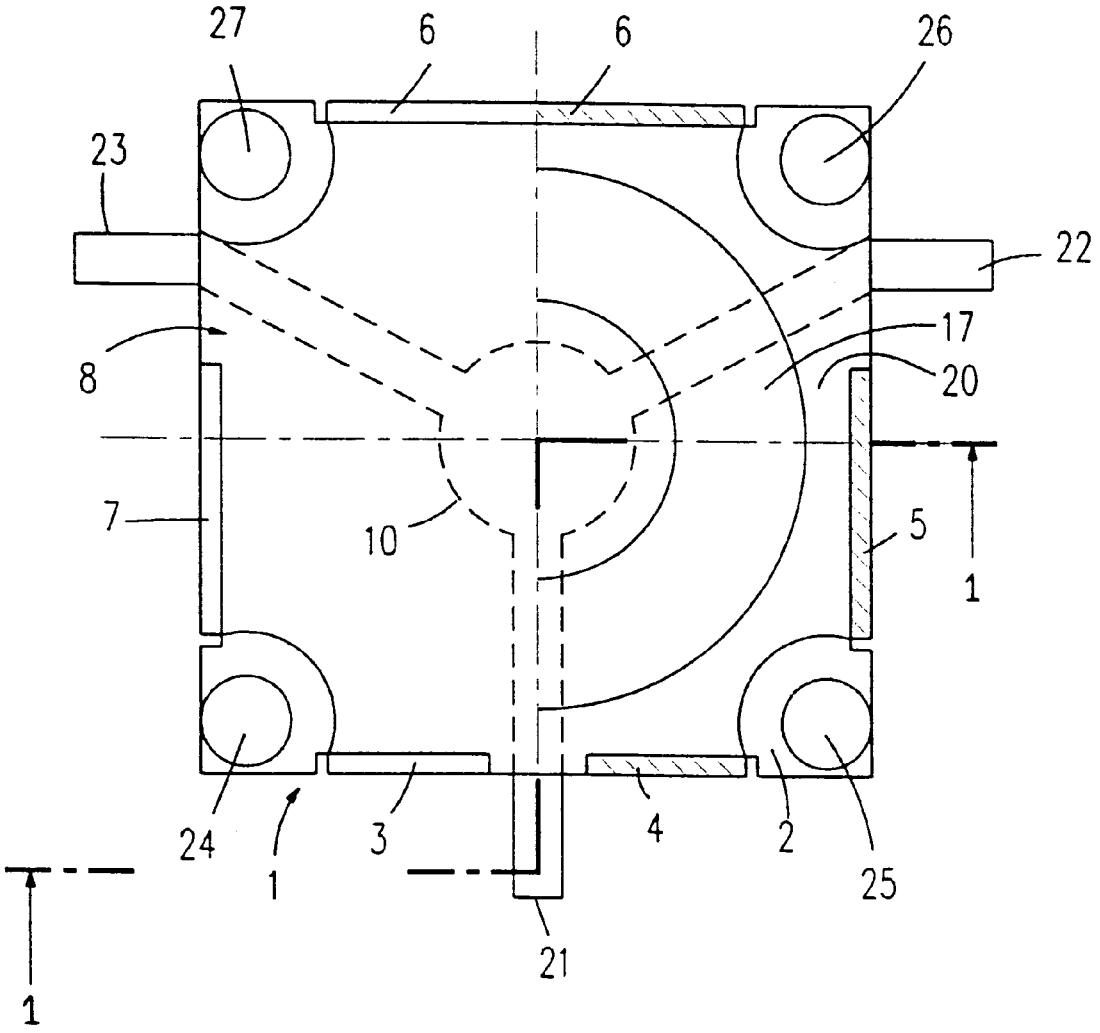
FIG. 5 is a cross-section of the microwave element of FIG. 1 taken on the line E—E.

In the inner space formed by the housing part 1 and the lid part 8, a number of substantially disc-shaped components are inserted in a stacked arrangement between the bottom portion 2 and the lid part 8. These are in that order, starting with the component adjoining the bottom portion 2: a first ferrite disc 9, a plane inner conductor 10, a second ferrite disc 11, a copper foil 12 forming an outer conductor, a first pole disc 13 of a magnetically permeable material, preferably the same material as the housing part 1 and the lid part 8, a thermoflux ring 14, a second pole disc 15 whose shape and material preferably correspond to those of the first pole disc 13, a permanent magnet 16 in the form of a circular disc, and a circular cup spring 17. The components having reference numerals 9 to 16 mentioned above are pressed against the bottom portion 2 by the cup spring 7 and fixed in their positions thereby. The inner conductor 10 is shown in broken lines in FIGS. 2 to 5 for purposes of orientation.

Between the components with reference numerals 9 to 17 in stacked arrangement as mentioned above on the one hand and the wall portions 3 to 7 on the other hand, the embodiment shown of the microwave element according to the invention has an intermediate space whose inner contour is formed by the circular edges of said components 9 to 17 and whose outer contour is formed by the wall portions 3 to 7 arranged in a quadrangle. This intermediate space is filled up in the microwave element shown by three substantially annular spacer elements 18, 19, 20 which are arranged with matching shapes between the components 9 to 17 on the one hand and the wall portions 3 to 7 on the other hand and which lie in a stacked arrangement on the bottom portion 2 up to the level of the lid part 8, as do the components 9 to 17 mentioned above.

In the Figure showing the embodiment described, the disc-shaped permanent magnet 16 and the thermoflux ring 14 have smaller diameters than the ferrite discs 9, 11, the pole discs 13, 15, and the cup spring 17. The permanent magnet and the thermoflux ring are locked against a sideways displacement in the plane of the surface of the bottom portion 2 and that of the lid part 8, respectively, by the static friction against the pole discs 13 and 15 and against the cup spring 17, owing to the pressure of the latter. If so desired, these elements may also have edges of alternative matching shapes in conjunction with the third spacer element 20 which adjoins them. It is also possible for the permanent magnet 16 to be surrounded by a further spacer element, or to be glued to the second pole disc 15.

The microwave element shown as an example of an embodiment forms a circulator realized with strip conductors, for which purpose three connection lines in the form of conductor strips are passed from the planar inner conductor 10 in the housing part 1 to the exterior. Of these, a first connection conductor 21 is passed between and electrically insulated from the first wall portion 3 and the second wall portion 4, a second connection conductor 22 is passed between the third wall portion 5 and the fourth wall portion 6, and a third connection conductor 23 is passed between the fourth wall portion 6 and the fifth wall portion 7. The connection conductors 21, 22, 23 may be passed to the exterior in the plane of the inner conductor 10 or bent into a different plane from the trough-shaped housing part 1. The connection conductors 21, 22, 23 are retained between the ferrite discs 9, 11 in the region of the diameter of these ferrite discs 9, 11, whereas outside these discs they are retained between the first spacer element 18 and the second spacer element 19. These spacer elements, whose heights correspond to the heights of the ferrite discs 9, 11, are preferably formed from a synthetic resin material which is electrically non-conductive and magnetically impermeable. The second ferrite disc 11 and the second spacer element 19 form a surface parallel to the planar extension of the bottom portion 2 in a direction away from the bottom portion 2, on which surface the outer conductor 12 lies in planar manner, making contact by its outer contour with the wall portions 3 to 7 with electrical conduction at least in some locations, but preferably continuously. As a result, the assembly of the bottom portion 2 and the outer conductor 12 acts as a planar parallel ground conductor device in whose central plane the inner conductor 10 is arranged with the connection conductors 21, 22, 23. The outer conductor 12 may be omitted, if so desired, so that a variation of the strip conductor type is possible in a simple manner.

As is apparent from the cross-sections of FIGS. 2 to 5, the spacer elements 18 to 20 are formed so as to reach up to the circumference of the bottom portion in the regions of the recesses between the wall portions 3 to 7. An optimum mechanical support is provided thereby especially for the connection conductors 21 to 23.

Through-holes are provided in the regions of the four corners of the bottom portion 2, through which holes the elements for fastening the microwave element to a support part (not shown) such as, for example, a mounting plate, a printed circuit board, or the like, can be passed, for example screws or rivets. All components stacked onto the bottom portion 2, i.e. the spacer elements 18, 19, 20 and the lid part 8 in the present example, have recesses in the regions of these through-holes 24, 25, 26, 27, so that said fastening means have no influence on the inner construction of the microwave element according to the invention.

In the embodiment shown, the lid part 8 lies on the stack of spacer elements 18, 19, 20 with matching and self-retaining shape, so that on the one hand it is brought into a defined position relative to the housing part 1 during assembly and on the other hand an abutment of the spacer elements 18, 19, 20 is also provided. At the same time, a defined prestress of the cup spring 17 is adjustable thereby without special measures having to be taken for this purpose. This also simplifies the assembly of the microwave element according to the invention.

The third spacer element 20 may be manufactured from an electrically conductive or non-conductive material, for example ceramic material, synthetic resin, or a magnetically impermeable metal such as, for example, aluminum. In particular, a temperature-resistant material is preferred here on account of the welding connection made between the housing part 1 and the lid part 8. The two other spacer elements 18, 19 may be advantageously formed from a material having a high dielectric constant, for example a suitable synthetic resin or a ceramic material, or possibly a synthetic resin with an embedded ceramic material added thereto. The region of the spacer elements 18, 19 can then be utilized in its entirety for the incorporation of compact microwave circuit elements which may be constructed, for example, in conductor strip technology such as the connection conductors 21, 22, 23.

The arrangement of the pole discs 13, 15 and the thermoflux ring 14 in the embodiment as shown serves for temperature compensation. If so desired, one of the pole discs 13, 15 and the thermoflux ring 14 may be omitted here.

The cup spring 17 can be specifically utilized for absorbing manufacturing tolerances in the dimensions of the components in the inner space of the housing part 1 in a direction perpendicular to the planar dimensions of the bottom portion 2 through a suitable dimensioning of this spring. The dimensioning of the cup spring 17 is preferably made such that the required pressure for retaining the components is safeguarded also in the case of an unfavorable total sum of the manufacturing tolerances. This leads to an additional saving in manufacturing cost of said components.

I claim:

1. A microwave element comprising:

a substantially trough-shaped housing part having a bottom portion and at least one wall portion merging into the circumference of the bottom portion, a lid part, which housing part and lid part enclose an inner space a plurality of substantially disc-shaped components arranged in a stack between the bottom portion and the lid part, wherein one of said substantially disc-shaped components is arranged as a circular cup spring and is positioned to provide a pressing force between said plurality of substantially disc-shaped components, said bottom portion and said lid part, wherein the housing part on the one hand and the lid part on the other hand are each formed as an integral part from a magnetically permeable material, and wherein the lid part is directly connected to the housing part by means of matching and mutually retaining shapes, and a magnetically impermeable spacer element arranged adjacent the stacked arrangement of the disc-shaped components in at least substantially the full height of the inner space between the bottom portion and the lid part so as to substantially fill up with matching shape an intermediate space between the stacked arrangement of the disc-shaped components and the at least one wall portion along at least part of that dimension of the at least one wall portion which extends at least substantially in the direction of the circumference of the bottom portion.

2. A microwave element as claimed in claim 1, wherein the spacer element has substantially a ring shape so that said spacer element at least substantially surrounds the stacked arrangement of the disc-shaped components along the circumference of the bottom portion extending at least substantially in the direction thereof.

3. A microwave element as claimed in claim 1, wherein the spacer element has substantially a ring shape so that said spacer element at least substantially surrounds the stacked arrangement of the disc-shaped components along the dimension of the at least one wall portion extending at least substantially in the direction thereof.

4. A microwave element as claimed in claim 1, wherein at least one of the substantially disc-shaped components is constructed as an electrical conductor, and the spacer element adjoining said at least one of the substantially disc-shaped components is formed from an electrically non-conductive material.

5. A microwave element as claimed in claim 4, wherein the spacer element adjoining said at least one of the substantially disc-shaped components is made from a material having a high dielectric constant.

6. A microwave element as claimed in claim 1, wherein the spacer element is made from a heat-resistant material.

7. A microwave element as claimed in claim 1, wherein the material for the spacer element comprises a ceramic material.

8. A microwave element as claimed in claim 1, wherein the lid part is glued to the housing part.

9. A microwave element as claimed in claim 1, wherein the lid part is welded to the housing part.

10. A microwave element as claimed in claim 1, wherein the lid part is soldered to the housing part.

11. A microwave circulator comprising:

a substantially trough-shaped housing part having a bottom portion and at least one wall portion merging into the circumference of the bottom portion, a lid part, which housing part and lid part enclose an inner space, wherein the housing part on the one hand and the lid part on the other hand are each formed as an integral part from a magnetically permeable material, wherein the lid part is directly connected to the housing part by means of matching and mutually retaining shapes, a plurality of substantially disc-shaped components arranged in a stack between the bottom portion and the lid part, wherein, a first one of said plurality of substantially disc-shaped components adjoins the bottom portion and is a first ferrite disc, a second one of said plurality of substantially disc-shaped components is positioned above said first ferrite disc and is arranged as a plane inner conductor, a third one of said plurality of substantially disc-shaped components is positioned above said plane inner conductor and is arranged as a second ferrite disc, a fourth one of said plurality of substantially disc-shaped components is positioned above said second ferrite disc and is arranged as an outer conductor, a fifth one of said plurality of substantially disc-shaped components is positioned above said outer conductor and is arranged as a pole disc, a sixth one of said plurality of substantially disc-shaped components is positioned above said pole disc and is arranged as magnet, a seventh one of said plurality of substantially disc-shaped components is arranged as a circular cup spring and is positioned to provide a pressing force between said plurality of substantially disc-shaped components, said bottom portion, and said lid part, and a magnetically impermeable spacer element arranged adjacent the stacked arrangement of the disc-shaped components in at least substantially the full height of the inner space between the bottom portion and the lid part so as to substantially fill up with matching shape an intermediate space between the stacked arrangement of the disc-shaped components and the at least one wall portion along at least part of that dimension of the at least one wall portion which extends at least substantially in the direction of the circumference of the bottom portion.

12. The microwave circulator of claim 11, wherein said pole disc is a first pole disc, wherein an eighth one of said plurality of substantially disc-shaped components is positioned above said first pole disc and is arranged as a thermoflux ring, and wherein a ninth one of said plurality of substantially disc-shaped components is positioned above said thermoflux ring and is arranged as a second pole disc.

* * * * *